US007303415B2

(12) United States Patent
Tyler

(10) Patent No.: US 7,303,415 B2
(45) Date of Patent: Dec. 4, 2007

(54) ELECTRICAL CONNECTOR WITH MATE-ASSIST AND A DUAL-POSITION WIRE DRESS COVER

(75) Inventor: Adam P. Tyler, Rochester Hills, MI (US)

(73) Assignee: FCI Americas Technology, Inc., Reno, NV (US)

( * ) Notice: Subject to any disclaimer, the term of this patent is extended or adjusted under 35 U.S.C. 154(b) by 26 days.

(21) Appl. No.: 11/395,695

(22) Filed: Mar. 31, 2006

(65) Prior Publication Data

US 2007/0232100 A1 Oct. 4, 2007

(51) Int. Cl.
*H01R 13/62* (2006.01)

(52) U.S. Cl. ..... 439/157; 439/347; 439/372

(58) Field of Classification Search ..... 439/152, 439/157, 160, 259, 347, 372
See application file for complete search history.

(56) References Cited

U.S. PATENT DOCUMENTS 5,489,224 A 2/1996 Schwarz ..... 439/752
5,681,175 A 10/1997 Busse et al. ..... 439/157
5,967,809 A * 10/1999 Fink et al. ..... 439/157
6,210,186 B1 * 4/2001 Fink et al. ..... 439/157
6,551,118 B2 * 4/2003 Langolf et al. ..... 439/157
6,666,697 B2 * 12/2003 Yamashita ..... 439/157
6,824,406 B1 11/2004 Sharples et al. ..... 439/157
7,267,564 B2 * 9/2007 Bauman et al. ..... 439/157
2005/0106911 A1 5/2005 Sharples et al. ..... 439/157

* cited by examiner

*Primary Examiner*—James R. Harvey
(74) *Attorney, Agent, or Firm*—Harrington & Smith, PC

(57) ABSTRACT

An electrical connector subassembly is provided. The subassembly includes a housing; a terminal position assurance device connected to the housing; and a wire dress cover adapted to be attached to the housing in at least two positions. The two positions include a first position wherein the wire dress cover covers the terminal position assurance device and a second position wherein the wire dress cover is adapted to cover wires extending to electrical terminals inserted into the housing.

21 Claims, 12 Drawing Sheets

ELECTRICAL CONNECTOR WITH MATE-ASSIST AND A DUAL-POSITION WIRE DRESS COVER

BACKGROUND OF THE INVENTION

1. Field of the Invention

The present invention relates to an electrical connector and, more particularly, to an electrical connector having a dual purpose cover.

2. Brief Description of Prior Developments

Some types of electrical connectors contain a terminal position assurance component (TPA). A TPA is a part of the connector which is designed to keep an electrical terminal or contact from backing out of the connector. A TPA typically has two states: an unlocked state and a final, latched state. The electrical connector is sometimes shipped by a manufacturer to a customer without the electrical contacts installed, wherein the customer inserts the contacts into the connector with wires attached to the contacts. Due to its function, prior to installation of the electrical contacts into the connector, the TPA is shipped to customers in its unlocked state.

Once the connector reaches the customer for final assembly with the electrical contacts, the TPA is locked into its final, latched position after the terminals have been inserted into the connector. While in the unlocked state, the TPA is in a position wherein it may be subject to accidental bumping or shifting (such as during shipping) that may accidentally push the TPA into its latched state. Such premature latching is inconvenient and undesirable. To avoid premature latching during shipping, typically expensive packaging is employed, such as cell or layered packs. There is a desire to provide a system to prevent accidental movement of a TPA to its latching position during shipping, but without use of expensive packaging.

SUMMARY OF THE INVENTION

In accordance with one aspect of the invention, an electrical connector subassembly is provided. The subassembly includes a housing; a terminal position assurance device connected to the housing; and a wire dress cover adapted to be attached to the housing in at least two positions. The two positions include a first position wherein the wire dress cover covers the terminal position assurance device and a second position wherein the wire dress cover is adapted to cover wires extending to electrical terminals inserted into the housing.

In accordance with another aspect of the invention, an electrical connector subassembly is provided. The subassembly includes a housing; a wire dress cover adapted to attach to the housing; at least one slider movably connected to the housing; and at least one lever connected to the housing and adapted to move the at least one slider relative to the housing. The at least one slider is adapted to enable a secure connection between the electrical connector subassembly and a corresponding mating connector. The at least one slider includes at least one cam track, wherein the at least one cam track includes at least one cam track lip.

In accordance with a further aspect of the invention a method is provided. The method includes the following steps. In an electrical connector subassembly having a housing, a terminal position assurance device connected to the housing and adapted to achieve at least two states comprising an unlocked state and a latched state, and a wire dress cover adapted to be attached to the housing in at least two positions comprising a first position wherein the wire dress cover covers the terminal position assurance device and a second position wherein the wire dress cover is adapted to cover wires extending to electrical terminals inserted into the housing, wherein the wire dress cover is in the first position and the terminal position assurance device is in the unlocked state, detach the wire dress cover from the housing. Insert the electrical terminals into the housing. Shift the terminal position assurance device to the latched state. Attach the wire dress cover to the housing in the second position.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
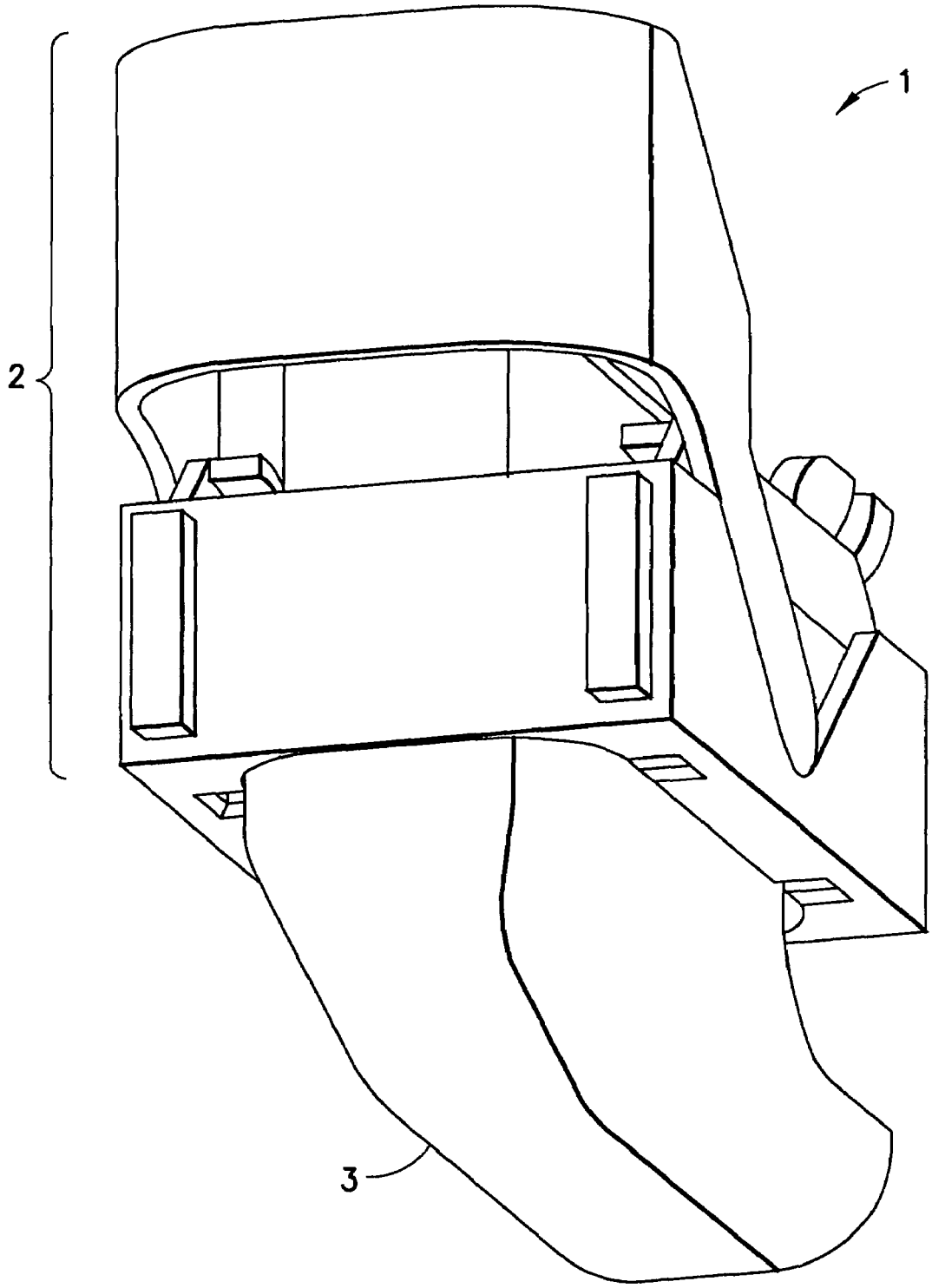
FIG. 1 is a front perspective view of an electrical connector subassembly incorporating features of the invention.

Referring to FIG. 1, there is shown a front perspective view of an electrical connector subassembly 1 incorporating features of the invention. Although the invention will be described with reference to the exemplary embodiment shown in the drawings, it should be understood that the invention can be embodied in many alternate forms of embodiments. In addition, any suitable size, shape or type of elements or materials can be used.

Electrical terminals 30 (see FIG. 7) connected to wires of a cable 32 (see FIG. 7) are inserted into the subassembly 1 to form an electrical cable harness comprising the cable 32 and the electrical connector 34 formed by the terminals 30 and the subassembly 1. The subassembly 1 is adapted to be shipped to a customer by a manufacturer for subsequent assembly of the terminals with the subassembly to form the connector and harness. In this embodiment the connector 34 is an automobile harness connector. However, in alternate embodiments features of the invention could be used in any suitable type of electrical connector or electrical connector environment.

The subassembly 1 in the embodiment shown generally comprises a connector assembly with a mate-assist system 2 and a wire dress cover 3. The subassembly 1 is enabled to achieve at least three states: a shipping state, an assembled state and a connected state. FIG. 1 shows the subassembly 1 in the shipping state. The particulars and advantages of the shipping state of FIG. 1 will be made clear as discussed with reference to FIG. 3 below. The assembled and connected states will be discussed below with reference to FIGS. 6 and 7, respectively.

Figure 2:
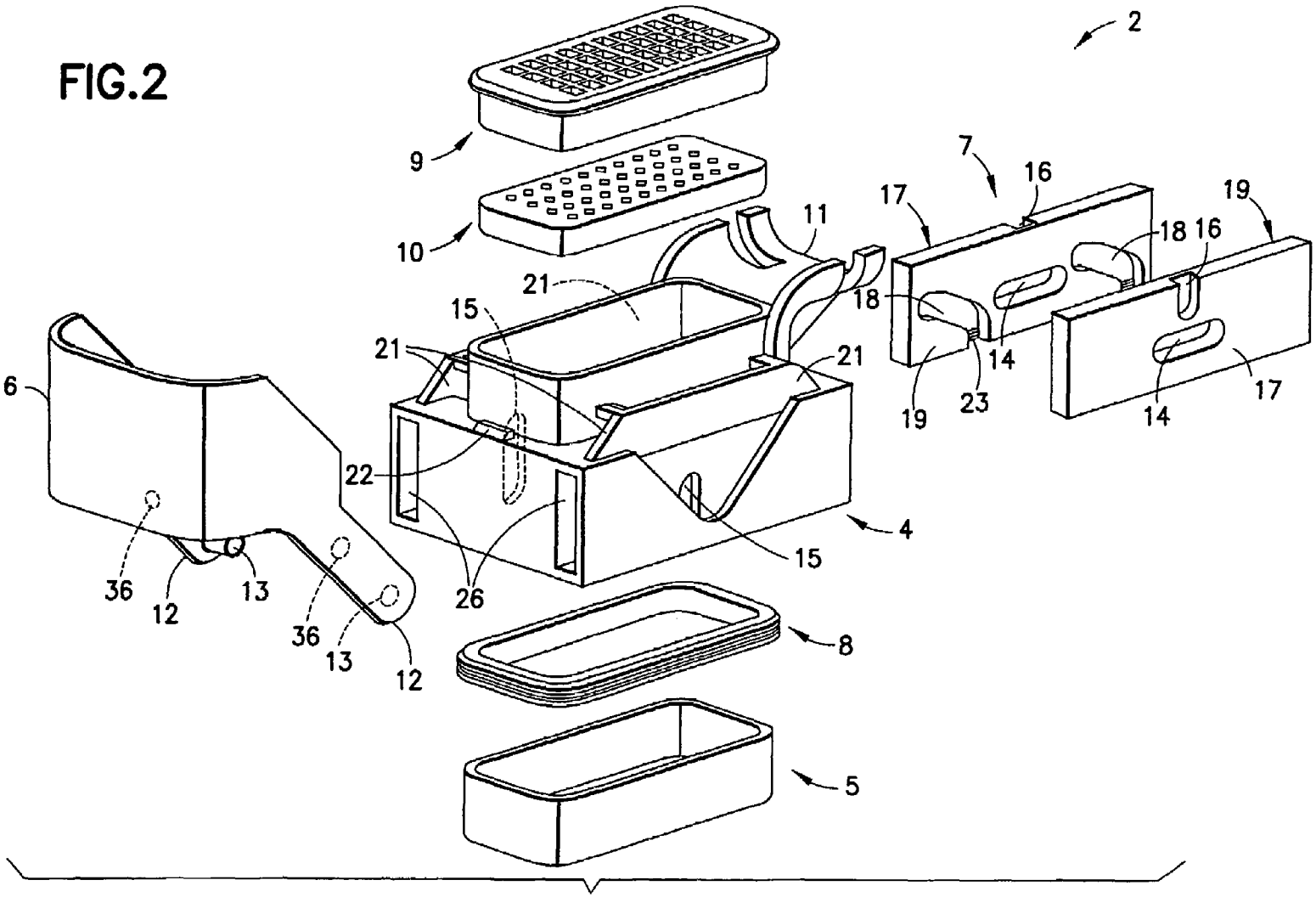
FIG. 2 is an exploded perspective view of the connector assembly shown in FIG. 1.
Figure 8:
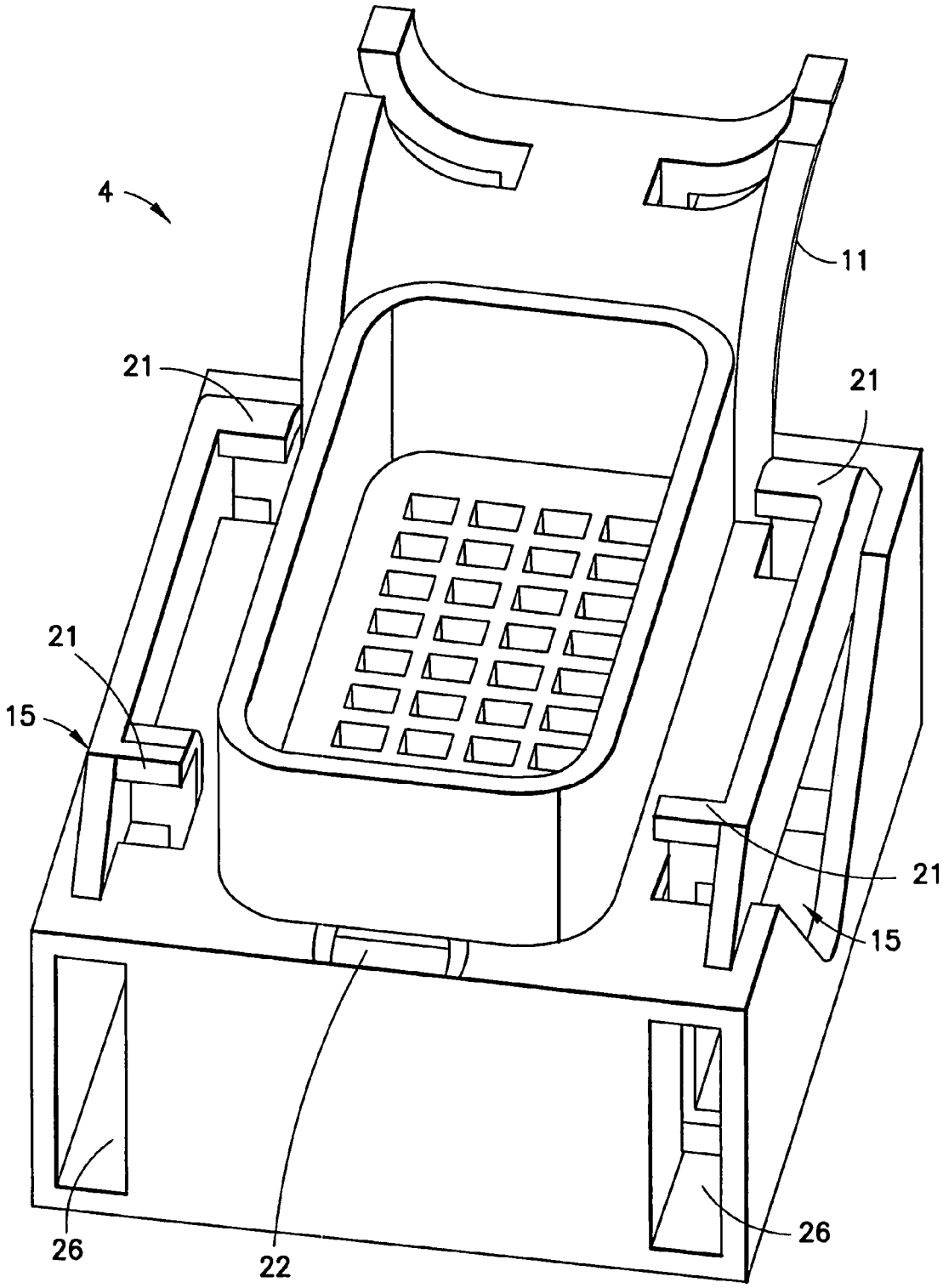
FIG. 8 is a perspective view of the housing of the connector assembly.
Figure 9:
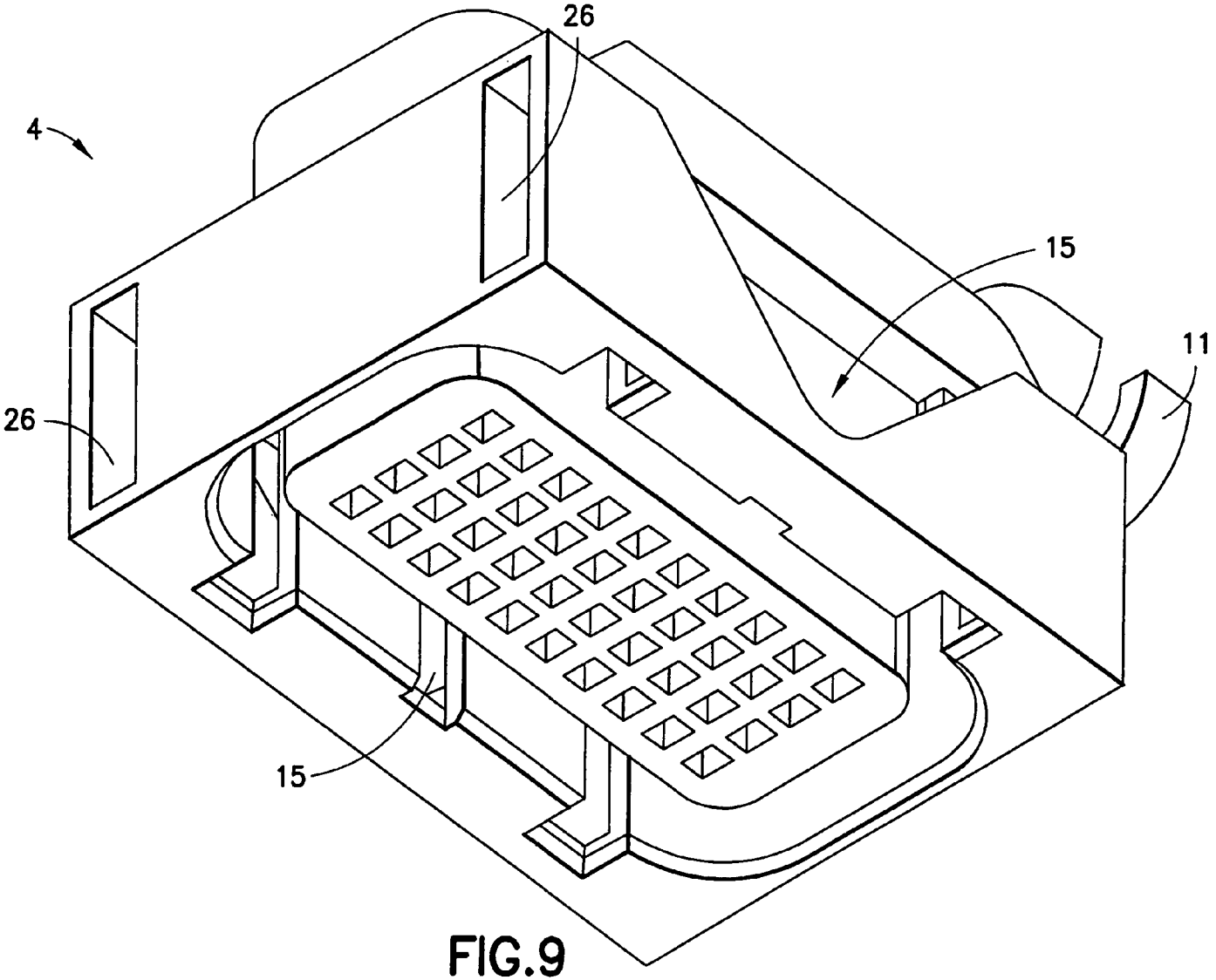
FIG. 9 is a bottom perspective view of the housing shown in FIG. 8.

FIG. 2 is an exploded perspective view of the connector assembly 2 shown in FIG. 1. The connector assembly 2 comprises a housing 4, a terminal position assurance (TPA) member 5, a lever 6, a pair of sliders 7, a perimeter seal 8, a wire seal cover 9 and a mat wire seal 10. The TPA S, perimeter seal 8, wire seal cover 9 and mat wire seal 10 are located inside the housing 4. Referring also to FIGS. 8 and 9, the housing 4 comprises a wire bundle support 11 located at one side of the housing, two lever post slots 15, four post hooks 21, a lip 22, and two slider slots 26. The post hooks 21 and lip 22 are discussed below with reference to FIG. 6. The slider slots 26 run along the entire length of the housing 4.

The lever 6 is pivotally connected with the housing 4 and sliders 7. The lever 6 is adapted to move the sliders 7 relative to the housing 4 and to facilitate mating with a mating connector 24 (see FIG. 7). The lever 6 is U-shaped and comprises two arms 12 with two sets of connector posts located on the interior face of each arm. A first pair of connector posts 13 pivotably connect the lever 6 to pivot relative to the housing 4. The lever pivoting posts 13 pass through lever pivoting slots 14 on the sliders 7 and are received by the lever post slots 15 on each lateral side of the housing 4. The lever 6 is enabled to achieve at least two states: an open state (as shown in FIGS. 1 and 3-6) and a closed state (as shown in FIG. 7). In the open state shown in FIGS. 1 and 3-6, the lever 6 is pivoted relative to the housing 4 such that it is positioned towards a first end of the connector assembly 2. In the closed state shown in FIG. 7, the lever 6 is positioned towards the opposite end of the connector assembly 2. These two states affect the position of the sliders 7 relative to the housing 4, as explained below. In addition, because the lever 6 can move the sliders 7, these two states carry implications when connecting the connector assembly 2 to a mating connector 24, as discussed below.

A second pair of connector posts 36, one each on the inner face of each arm of the lever 6, are adapted to move the sliders 7 relative to the housing 4 when the lever 6 is pivoted on the housing. The lever slide posts 36 are located in the slider slots 16 located on the exterior face 17 of each slider 7. In such a manner, the sliders 7 are positioned towards the first end of the connector assembly 2 when the lever 6 is in the open state shown in FIGS. 1 and 3-6, and towards the opposite second end of the connector assembly 2 when the lever 6 is in the closed state shown in FIG. 7.

The sliders 7 are slidably supported in the slider slots 26 on the housing 4. The sliders 7 are adapted to move relative to the housing 4, between the opposite ends of the connector assembly 2 as explained above. In addition to the lever pivoting slots 14 and slider slots 16 noted above, the sliders 7 each comprise two cam tracks 18. The cam tracks 18 are located on the interior face 19 of each slider. The cam tracks 18 comprise inward projecting cam track lips 23 at the entrances to the tracks 18. In a shipping configuration shown in FIG. 1, the cam tracks 18 receive posts 20 of the cover 3. However, in the use configuration shown in FIG. 7, the cam tracks 18 are adapted to receive mating posts 25 of a mating header connector 24 (see FIG. 7). The cam track lips 23 also serve to retain the wire dress cover 3 when the subassembly 1 is in the shipping state, as discussed below with reference to FIG. 3. The cam track lips 23 on the sliders 7 can be seen more clearly in FIG. 11.

As seen with reference to FIG. 7, the connector 34 is connected to the mating connector 24 by installing the bottom of the connector 34 onto the top of the mating connector 24. During this connecting process, the mating header connector's mating posts 25 are received by the cam tracks 18 on the sliders 7 with the lever 6 in the open state. Subsequently, the lever 6 is shifted to the closed state, moving the sliders 7 toward the opposite end of the connector assembly 2. In so doing, the cam tracks 18 on the sliders 7 move relative to the mating posts 25 of the mating header connector 24 and draw the two connectors 34, 24 together as indicated by arrow 38.

Figure 3:
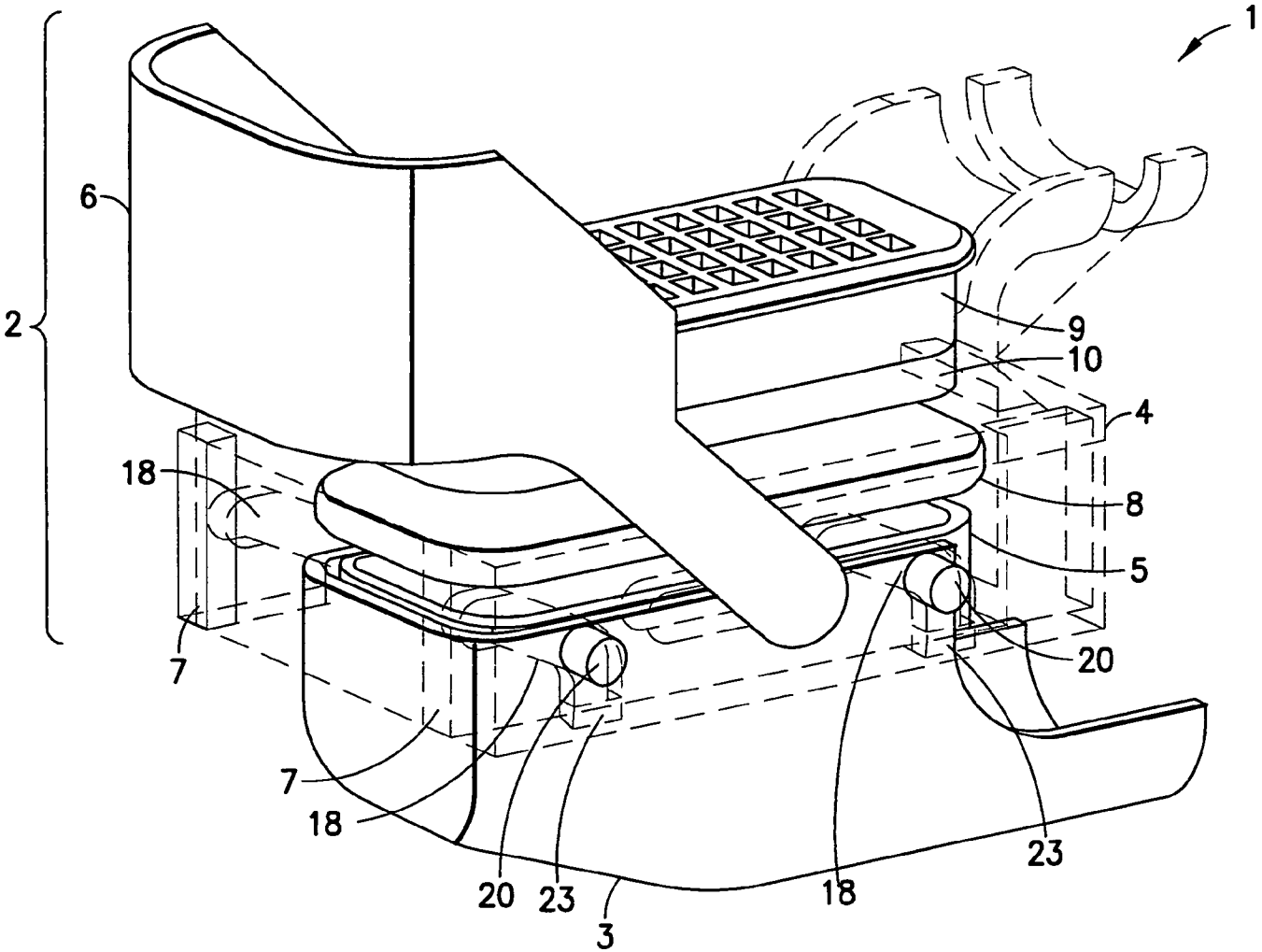
FIG. 3 is a perspective view of the automotive harness connector in the shipping state.

FIGS. 3-7 show perspective views of the automotive harness connector 1 in sequential order as the automotive harness connector 1 is shifted from a shipping state (FIG. 3) to an assembled state (FIG. 6) to a connected state (FIG. 7). In FIGS. 3-7, the housing 4 and sliders 7 are shown in phantom lines such that the interior components of the connector assembly 2 are visible. FIG. 3 illustrates this more clearly as the TPA 5, perimeter seal 8, wire seal cover 9 and mat wire seal 10 are all visible and identified.

FIG. 3 is a perspective view of the subassembly 1 in the initial shipping state. In the shipping state, the wire dress cover 3 is temporarily attached to the bottom of the connector assembly 2, the TPA 5 is in the unlocked state, as evidenced by the gap between the TPA 5 and the perimeter seal 8, and the lever 6 is in the open state with the lever 6 and sliders 7 positioned substantially towards the first end of the connector assembly 2. The temporary attachment of the wire dress cover 3 is enabled by four cover posts 20 on the wire dress cover 3. The cover posts 20 engage the cam track lips 23 of the cam tracks 18 on the sliders 7 to retain the wire dress cover 3. In such a manner, the wire dress cover 3 protects the bottom of the connector assembly 2 from accidental or undesired contact. Thus, the TPA 5, which is located on the bottom of the connector assembly 2, is protected against accidental shifting from its unlocked state into the latched state.

Figure 4:
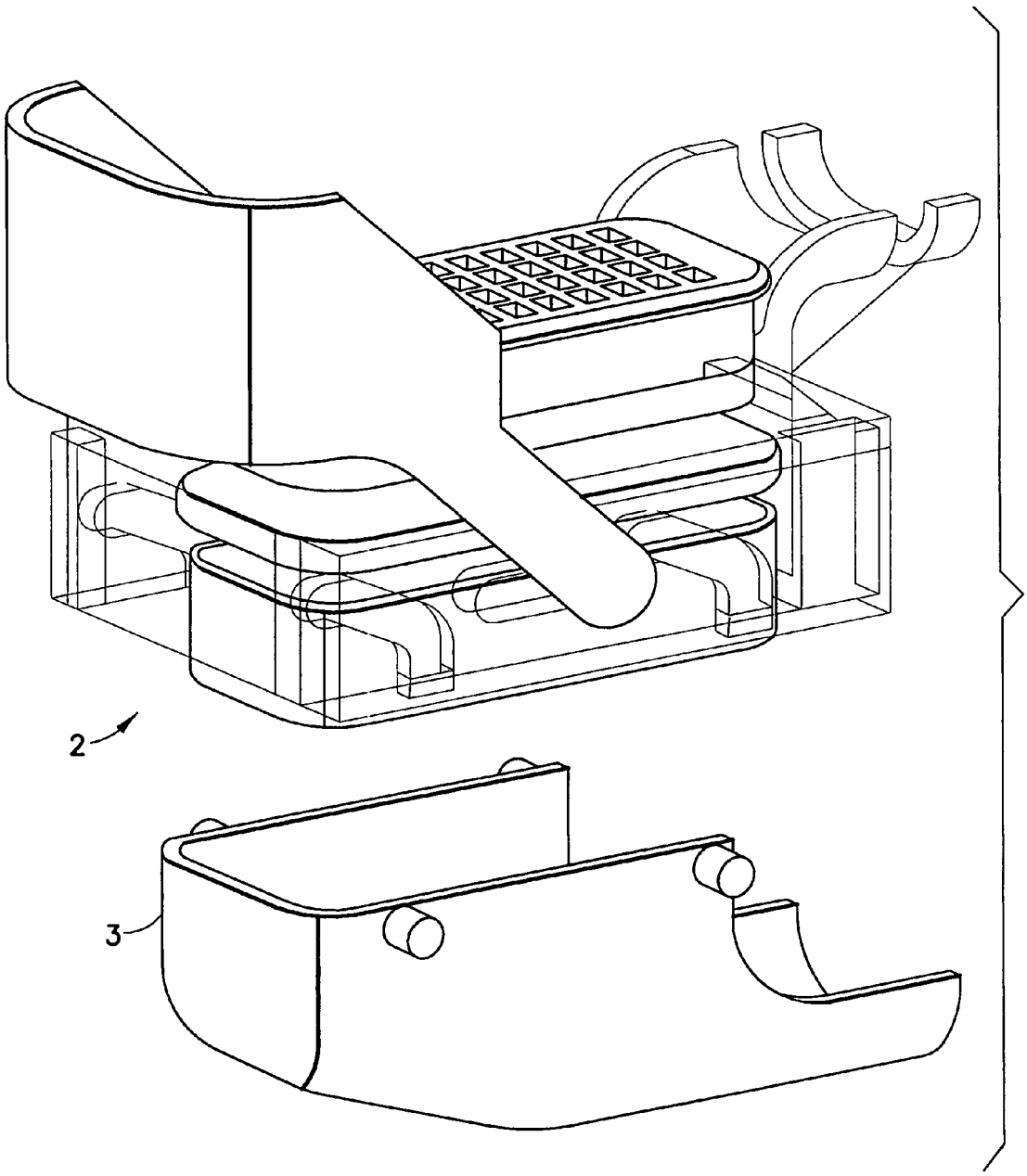
FIG. 4 is a perspective view of the automotive harness connector after the wire dress cover has been removed from the shipping state shown in FIG. 3.
Figure 5:
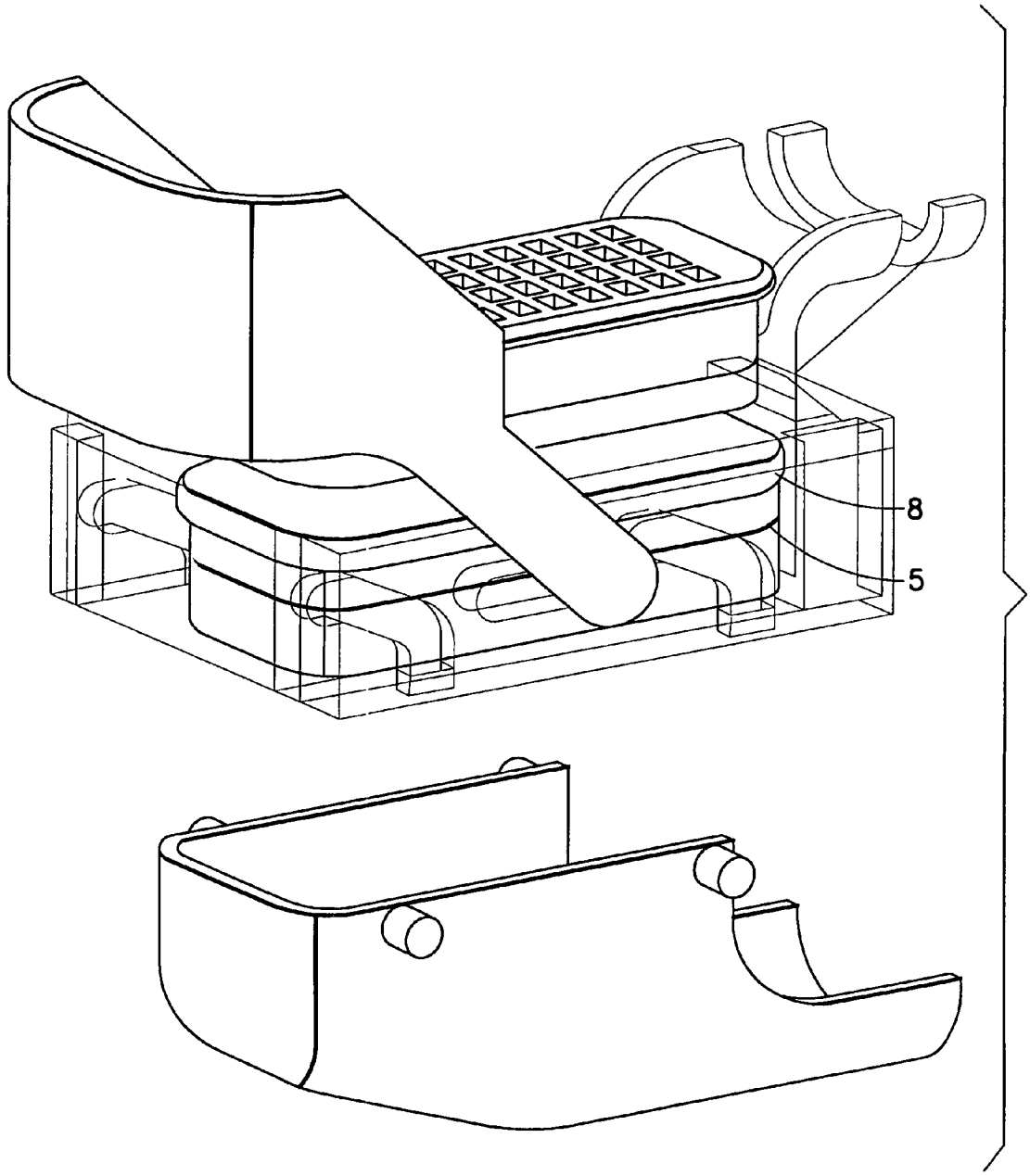
FIG. 5 is a perspective view of the automotive harness connector after the TPA has been shifted into the latched position as from the unlocked position shown in FIG. 4.

In FIG. 4, the wire dress cover 3 has been detached from the connector assembly 2. At this time, the wire bundle 32 is connected to the connector assembly 2. The wire bundle 32 (see FIG. 6) is received at the rear of the connector assembly 2 and supported by the wire bundle support 11. The terminals 30 (see FIG. 6) on the wire bundle 32 are inserted into the top of the connector assembly 2 and connected to the connector assembly 2 by means of the wire seal cover 9 and the TPA 5. As shown in FIG. 5, the TPA 5 is then pushed into its latched state. The TPA 5 securely retains the electrical terminals in their retaining holes to prevent the terminals from being inadvertently removed from the retaining holes.

Figure 6:
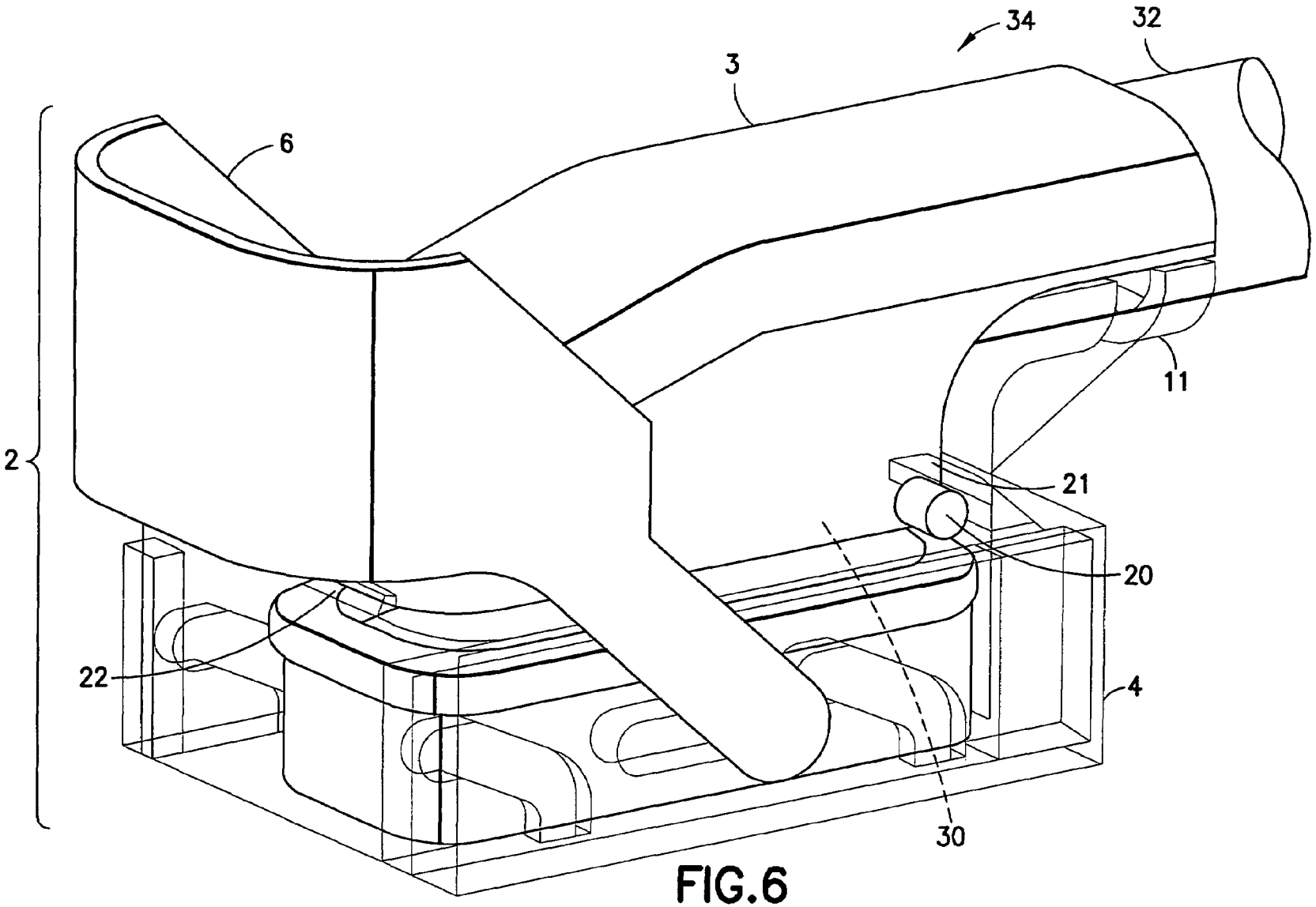
FIG. 6 is a perspective view of the automotive harness connector in the assembled state.
Figure 7:
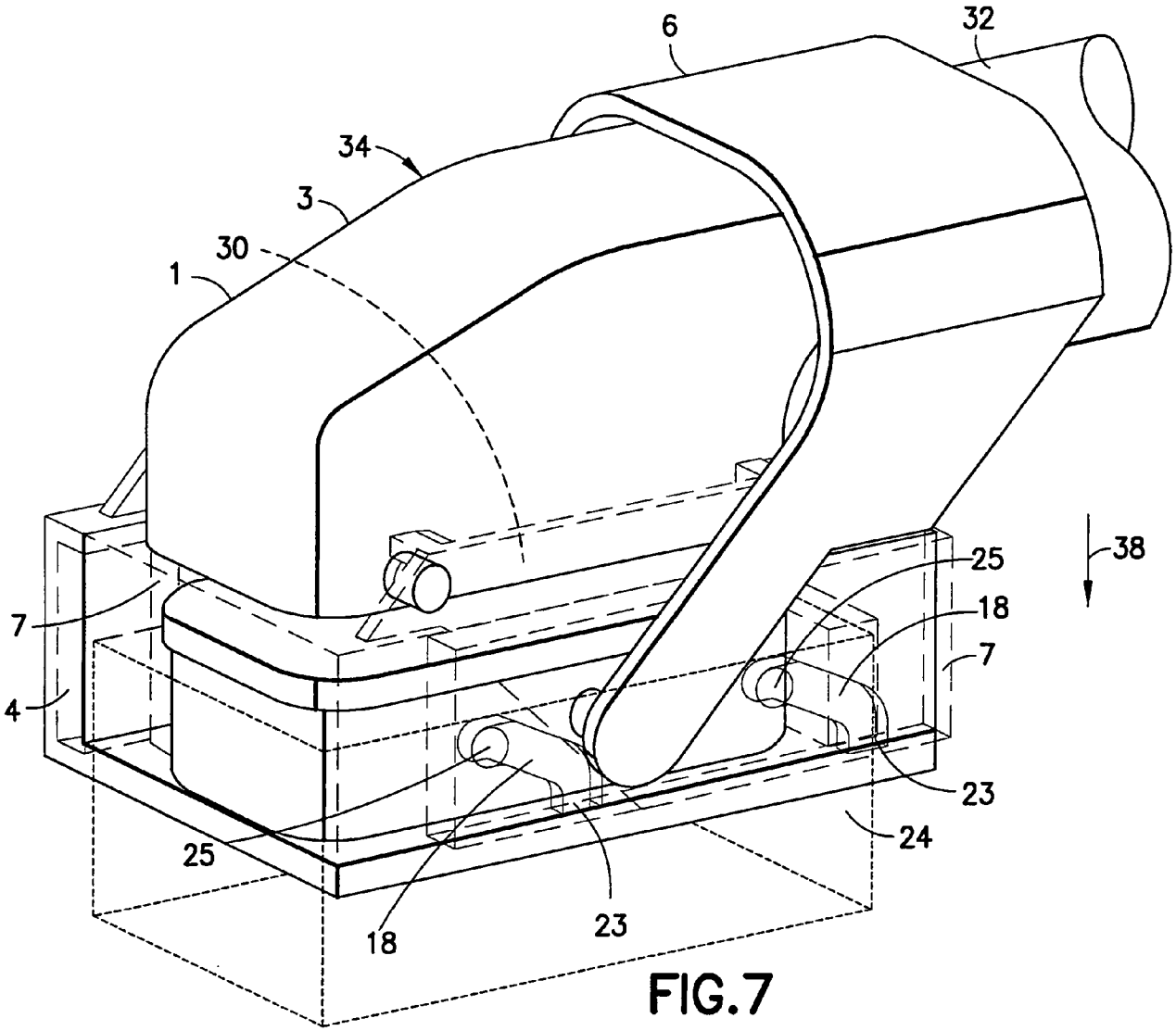
FIG. 7 is a perspective view of the automotive harness connector in the connected state as connected to a mating header connector.

FIG. 6 shows the electrical connector 34 in its assembled state. The wire dress cover 3 has been slid and locked into place on the top of the housing 4 such that it is securely retained thereon. The attachment of the wire dress cover 3 to the housing 4 is effected by the four cover posts 20 of the wire dress cover 3 engaging the four post hooks 21 located on the housing 4. The attachment is further secured by the lip 22 on the housing 4. The post hooks 21 and lip 22 of the housing 4 can be seen more clearly in FIG. 8. In the assembled state, the wire dress cover 3 is located over the wire bundle 32 that is attached to the connector assembly 2 and the lever 6 is still in its open state. The assembled state shown in FIG. 6 is the state of the connector 34 prior to connection with a mating connector 24.

FIG. 7 shows the connector 34 in the connected state and connected to the mating connector 24. To connect the connector 34 to the mating connector 24, the connector 34 is located on top of the mating connector 24. Mating posts 25 on the mating header connector 24 engage the cam tracks 18 on the sliders 7. Initially, the mating header connector 24 is retained on the automotive harness connector 1 by the cam track lips 23 retaining the mating posts 25. Subsequently, the lever 6 is pivoted from the open state to the closed state. In the connected state, the lever 6 has been moved from its position shown in FIG. 6 to its closed state and, thus, is positioned towards the opposite end of the connector assembly 2. In so doing, the sliders 7 are moved towards the opposite end of the housing 4 and the cam tracks 18, thus, move relative to the mating posts 25, drawing the two connectors together.

The cam tracks 18 are used to retain both the cover posts 20 of the wire dress cover 3 (in the shipping state) and the mating posts 25 of the mating header connector 24 (in the connected state). The post hooks 21 of the housing 4 are used to retain the wire dress cover 3 by retaining the cover posts 20. The number and placement of the cover posts 20, cam tracks 18 and post hooks 21 substantially correspond to the number and placement of the mating posts 25. In other alternate embodiments, different connection means, other than posts, may be employed to assure the connections.

FIG. 8 is a perspective view of the housing 4 of the connector assembly 2. As noted in discussing FIG. 2, the housing 4 comprises a wire bundle support 11 located towards one end of the housing, two lever post slots 15, four post hooks 21, a lip 22, and two slider slots 26. To connect the wire dress cover 3 to the housing 4 and enable the connector 34 to achieve the assembled state, the wire dress cover 3 is located over the wire bundle 34 and slid toward the rear of the connector assembly 2 so that the cover posts 20 of the wire dress cover 3 move under the post hooks 21. The edge of the wire dress cover 3 snaps over the lip 22. FIG. 9 is a bottom perspective view of the housing 4 shown in FIG. 8.

Figure 10:
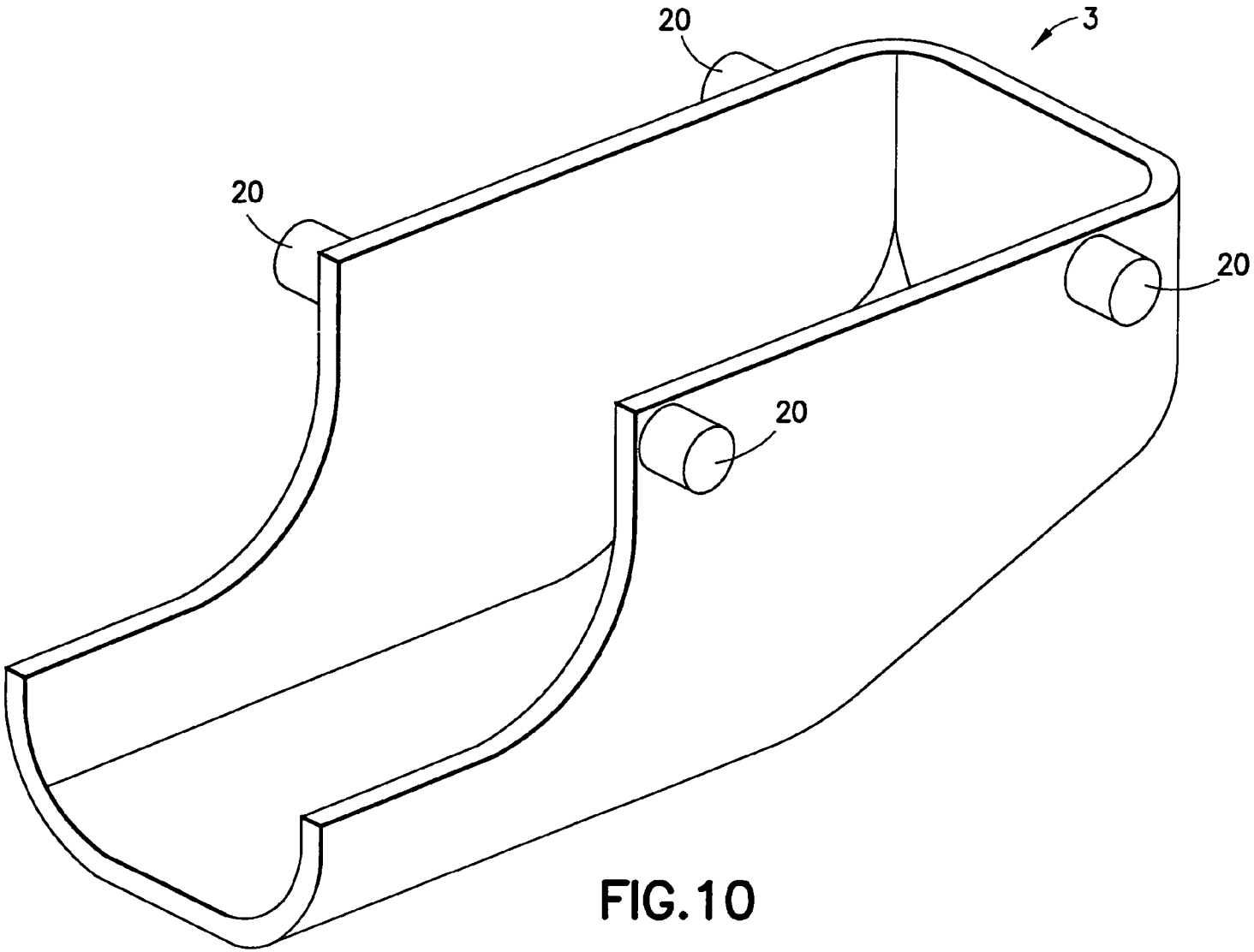
FIG. 10 is a perspective view of the wire dress cover.

FIG. 10 is a perspective view of the wire dress cover 3. The four cover posts 20 are readily apparent. The cover posts 20 on the wire dress cover 3 match to the size and location of the mating posts 25 on the mating header connector 24. The cover posts 20 of the wire dress cover 3 are utilized to retain the wire dress cover both in the shipping state (FIGS. 1 and 3) and the assembled state (FIG. 6).

Figure 11:
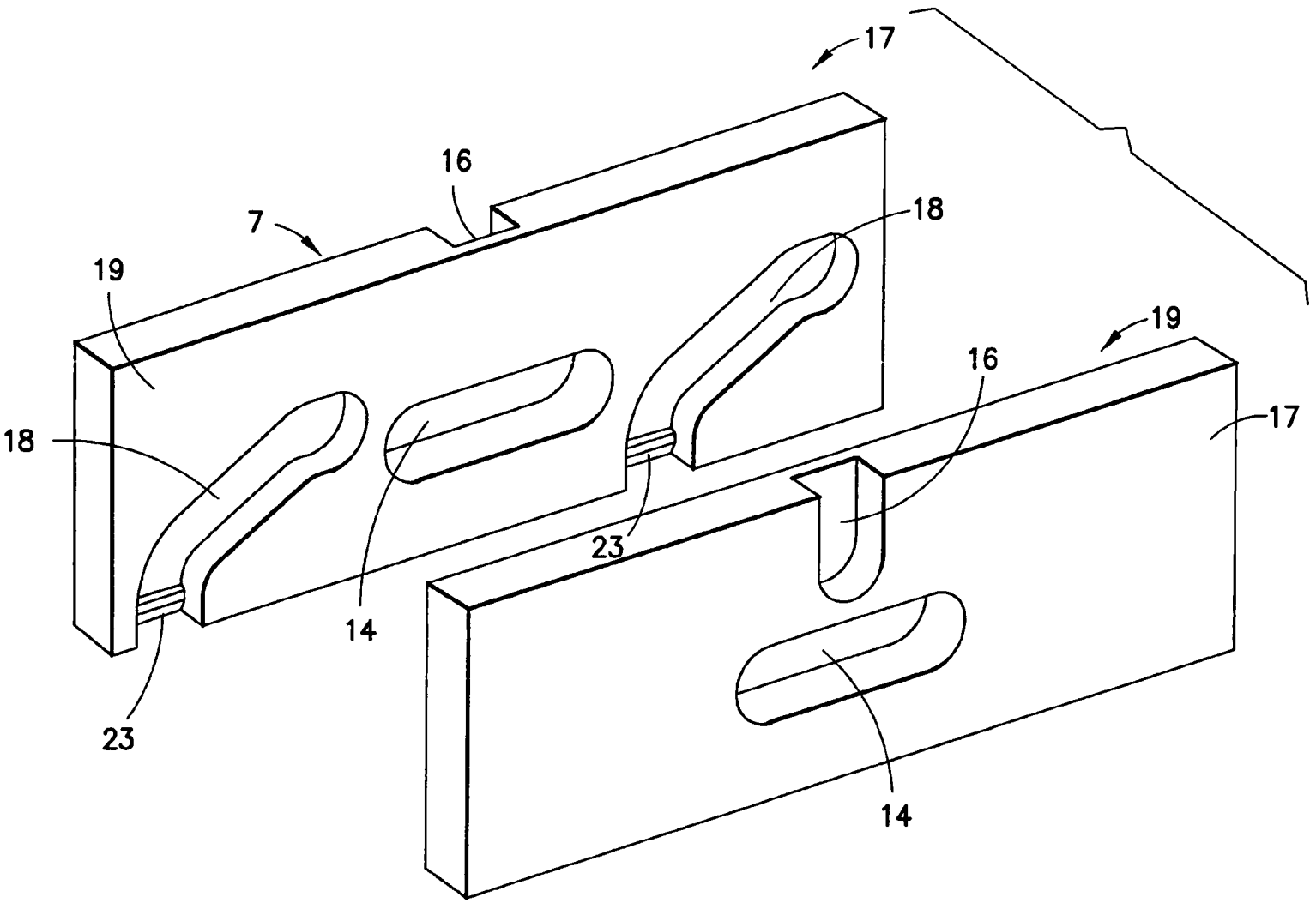
FIG. 11 is a perspective view of the sliders of the connector assembly.

FIG. 11 is a perspective view of the sliders 7 of the connector assembly 2. The sliders 7 comprise lever pivoting slots 14, slider slots 16 located on the exterior faces 17 of the sliders 7, cam tracks 18 located on the interior faces 19 of the sliders 7, and cam track lips 23 located near the bottom of the cam tracks 18. The cam track lips 23 are utilized for temporarily retaining the wire dress cover 3 in the shipping state.

Figure 12:
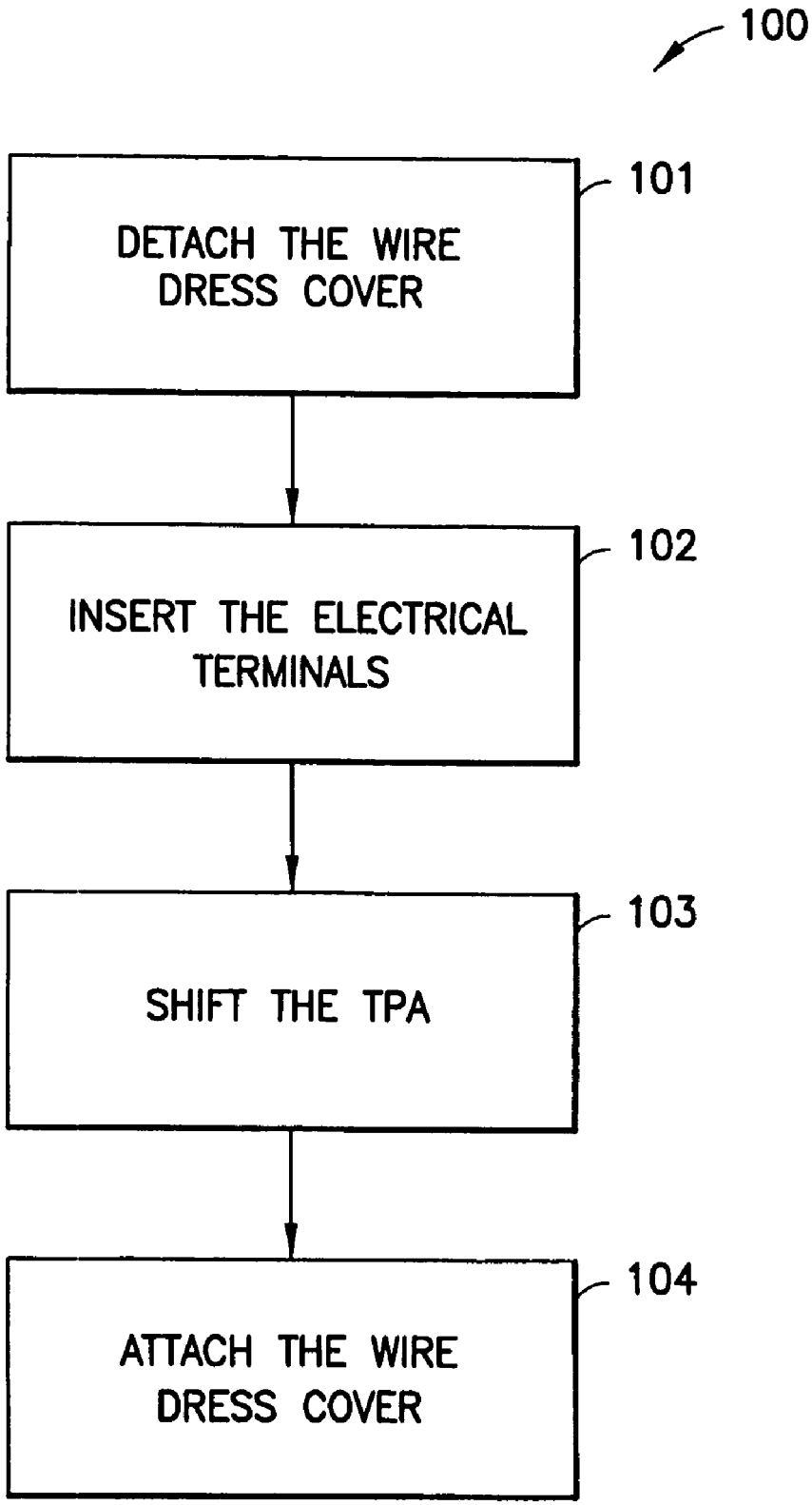
FIG. 12 is a flow chart illustrating an exemplary method for practicing the exemplary embodiments of the invention.

FIG. 12 shows a flow chart illustrating one non-limiting example of a method 100 for practicing the exemplary embodiments of this invention. The method 100 of FIG. 12 includes the following steps. In box 101, in an electrical connector subassembly having a housing, a terminal position assurance device (TPA) connected to the housing and adapted to achieve at least two states comprising an unlocked state and a latched state, and a wire dress cover adapted to be attached to the housing in at least two positions comprising a first position wherein the wire dress cover covers the terminal position assurance device and a second position wherein the wire dress cover is adapted to cover wires extending to electrical terminals inserted into the housing, wherein the wire dress cover is in the first position and the TPA is in the unlocked state, detach the wire dress cover from the housing. In box 102, insert the electrical terminals into the housing. In box 103, shift the TPA to the latched state. In box 104, attach the wire dress cover to the housing in the second position.

It is desirable to provide techniques that enable an electrical connector with a TPA to be safely shipped such that the TPA is protected from accidental shifting into its latched state. To accomplish this, a wire dress cover is enabled to temporarily attach to the connector assembly in a shipping position that protects the TPA from accidental or undesired contact; that might otherwise shift the TPA from its unlocked state into its latched state. By utilizing the wire dress cover in this manner, not only is the TPA protected during shipping, thus enabling the connector assembly to be shipped using less expensive packaging such as bulk packs, but the connector assembly and wire dress cover can be shipped together as opposed to separately or loosely.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector subassembly comprising:

a housing;

a terminal position assurance device comprising a top portion and a bottom mating portion, wherein the top portion of the terminal position assurance device is connected to the housing; and a wire dress cover attached to the housing in at least two alternative positions, wherein:

in a first one of the positions the wire dress cover covers the bottom mating portion of the terminal position assurance device; and in a second one of the positions the wire dress cover is adapted to cover wires which extend from electrical terminals within the housing.

2. The electrical connector subassembly of claim 1, wherein the wire dress cover comprises a plurality of posts and wherein the housing comprises a plurality of post hooks for receiving and retaining the plurality of posts of the wire dress cover.

3. The electrical connector subassembly of claim 1, wherein the electrical connector subassembly is part of an automotive harness connector.

4. An electrical connector subassembly comprising:

a housing;

a terminal position assurance device comprising a top portion attached to the housing and a bottom mating portion;

a wire dress cover adapted to attach to the housing in at least two alternative positions; wherein in a first one of the positions, the wire dress cover covers the bottom mating portion of the terminal position assurance device; and in a second one of the positions the wire dress cover is adapted to cover wires which extend from electrical terminals within the housing;

at least one slider movably connected to the housing; and at least one lever connected to the housing and adapted to move the at least one slider relative to the housing, wherein the at least one slider is adapted to enable a secure connection between the electrical connector subassembly and a corresponding mating connector, wherein the at least one slider comprises at least one cam track, wherein the at least one cam track comprises at least one cam track lip.

5. The electrical connector subassembly of claim 4, wherein the at least one cam track lip of the at least one cam track is adapted to retain the wire dress cover.

6. The electrical connector subassembly of claim 4, wherein the corresponding mating connector comprises mating connection means for connecting with the electrical connector subassembly and wherein the wire dress cover comprises cover connection means for attaching to the housing.

7. The electrical connector subassembly of claim 6, wherein the cover connection means substantially corresponds in design and placement to the mating connection means.

8. The electrical connector subassembly of claim 6, wherein the mating connection means comprises a plurality of mating posts and wherein the cover connection means comprises a plurality of cover posts.

9. The electrical connector subassembly of claim 8, wherein the housing comprises post hooks for receiving the plurality of cover posts and retaining the wire dress cover.

10. The electrical connector subassembly of claim 9, wherein the plurality of cover posts substantially correspond in design and placement to the plurality of mating posts.

11. The electrical connector subassembly of claim 9, wherein the at least one cam track lip of the at least one cam track is adapted to receive and retain the cover posts and wherein the at least one cam track lip of the at least one cam track is adapted to receive and retain the mating posts.

12. A method of using a wire dress cover in conjunction with an electrical connector housing comprising:

connecting the wire dress cover to the housing at a first position which covers a bottom mating portion of a terminal position assurance device, wherein a top portion of the terminal position assurance device is connected to the housing; and moving the wire dress cover to a second position on the housing such that the wire dress cover covers wires which extend from the housing such that said second position permits access to the mating portion of the terminal position assurance device.

13. The electrical connector subassembly of claim 1, further comprising at least one slider movably connected to the housing; and at least one lever connected to the housing and adapted to move the at least one slider relative to the housing.

14. The electrical connector subassembly of claim 13, wherein the at least one slider is adapted to enable a secure connection between the electrical connector subassembly and a corresponding mating connector, wherein the at least one slider comprises at least one cam track, and wherein the at least one cam track comprises at least one cam track lip.

15. The electrical connector subassembly of claim 14, wherein the at least one cam track lip of the at least one cam track is adapted to retain the wire dress cover.

16. The electrical connector subassembly of claim 14, wherein the corresponding mating connector comprises mating connection means for connecting with the electrical connector subassembly and wherein the wire dress cover comprises cover connection means for attaching to the housing.

17. The electrical connector subassembly of claim 16, wherein the cover connection means substantially corresponds in design and placement to the mating connection means.

18. The electrical connector subassembly of claim 16, wherein the mating connection means comprises a plurality of mating posts and wherein the cover connection means comprises a plurality of cover posts.

19. The electrical connector subassembly of claim 18, wherein the housing comprises post hooks for receiving the plurality of cover posts and retaining the wire dress cover.

20. The electrical connector subassembly of claim 19, wherein the plurality of cover posts substantially correspond in design and placement to the plurality of mating posts.

21. The electrical connector subassembly of claim 19, wherein the at least one cam track lip of the at least one cam track is adapted to receive and retain the cover posts and wherein the at least one cam track lip of the at least one cam track is adapted to receive and retain the mating posts.

* * * * *